US010287898B2

(12) United States Patent
Bluck

(10) Patent No.: US 10,287,898 B2
(45) Date of Patent: May 14, 2019

(54) BLADE ROOT, CORRESPONDING BLADE, ROTOR DISC, AND TURBOMACHINE ASSEMBLY

(75) Inventor: Richard Bluck, Welton (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 851 days.

(21) Appl. No.: 14/232,661

(22) PCT Filed: Jul. 5, 2012

(86) PCT No.: PCT/EP2012/063105
§ 371 (c)(1),
(2), (4) Date: Jan. 14, 2014

(87) PCT Pub. No.: WO2013/007587
PCT Pub. Date: Jan. 17, 2013

(65) Prior Publication Data

US 2014/0140852 A1 May 22, 2014

(30) Foreign Application Priority Data

Jul. 14, 2011 (EP) ..... 11174019

(51) Int. Cl.
*F01D 5/30* (2006.01)

(52) U.S. Cl.
CPC ..... *F01D 5/3007* (2013.01); *F01D 5/3023* (2013.01)

(58) Field of Classification Search
CPC .... F01D 5/3007; F01D 5/3038; F01D 5/3046; F01D 5/3092
USPC ..... 416/219 R, 248
See application file for complete search history.

(56) References Cited

U.S. PATENT DOCUMENTS 4,191,509 A * 3/1980 Leonardi ..... F01D 5/3015 416/219 R
4,260,331 A * 4/1981 Goodwin ..... F01D 5/3007 416/219 R
5,110,262 A * 5/1992 Evans ..... F01D 5/3007 416/219 R
5,141,401 A * 8/1992 Juenger ..... F01D 5/3007 416/219 R
5,554,005 A 9/1996 Nguyen
6,033,185 A * 3/2000 Lammas ..... F01D 5/3038 416/193 A
6,106,188 A * 8/2000 Krautzig ..... F01D 5/3007 403/28

(Continued)

FOREIGN PATENT DOCUMENTS

CN 101050711 A 10/2007
CN 101672200 A 3/2010

(Continued)

*Primary Examiner* — Justin D Seabe
*Assistant Examiner* — Juan G Flores

(57) ABSTRACT

A blade root including of a plurality of lobes and fillets and flanks in between is provided. A shoulder is provided between the flanks and the fillets to increase the distance to a corresponding lobe of a corresponding rotor disc into which a blade with such a blade root is inserted. A rotor blade having such a blade root is also provided. Furthermore this feature may alternatively or additionally also be applied to a rotor disc slot of a rotor disc, such that a flank of the rotor disc slot merges into a fillet of the rotor disc slot via a soft shoulder to increase the distance to a corresponding lobe of a blade root. A shoulder could also be applied to both the blade root and the corresponding slot of the rotor disc.

13 Claims, 8 Drawing Sheets

(56) References Cited

U.S. PATENT DOCUMENTS

| | | | | |
|---|---|---|---|---|
| 6,183,202 | B1 * | 2/2001 | Ganshaw | F01D 5/3007 416/219 R |
| 6,592,330 | B2 * | 7/2003 | Leeke | F01D 5/3007 29/889.21 |
| 6,860,721 | B2 * | 3/2005 | Knott | F01D 5/30 416/219 R |
| 7,513,747 | B2 * | 4/2009 | Bachofner | F01D 5/3038 416/215 |
| 7,594,799 | B2 * | 9/2009 | Miller | F01D 5/147 416/219 R |
| 2008/0063529 | A1 | 3/2008 | Busbey | |
| 2008/0206060 | A1 * | 8/2008 | Roberts | B23H 9/10 416/219 R |
| 2008/0298972 | A1 | 12/2008 | Le Hong | |
| 2009/0022591 | A1 * | 1/2009 | Mujezinovic | F01D 5/3007 416/219 R |

FOREIGN PATENT DOCUMENTS

| | | | |
|---|---|---|---|
| CN | 102102545 | A | 6/2011 |
| DE | 3236021 | A1 | 5/1983 |
| DE | 19537549 | A1 | 4/1996 |
| DE | 10247767 | A1 | 5/2003 |
| DE | 102007042829 | A1 | 3/2008 |
| EP | 0478234 | A1 | 4/1992 |
| EP | 0431766 | B1 | 2/1996 |
| EP | 0889202 | A2 | 1/1999 |
| EP | 1048821 | A2 | 11/2000 |
| EP | 0889202 | B1 | 2/2004 |
| GB | 2343225 | A | 5/2000 |
| GB | 2380770 | A | 4/2003 |
| JP | 59113206 | A | 6/1984 |
| JP | 03182603 | A | 8/1991 |
| UA | 47583 | U | 2/2010 |
| WO | WO 2011082237 | A1 | 7/2011 |

* cited by examiner

BLADE ROOT, CORRESPONDING BLADE, ROTOR DISC, AND TURBOMACHINE ASSEMBLY

CROSS REFERENCE TO RELATED APPLICATIONS

This application is the US National Stage of International Application No. PCT/EP2012/063105 filed Jul. 5, 2012 and claims benefit thereof, the entire content of which is hereby incorporated herein by reference. The International Application claims priority to the European Patent Office application No. 11174019.7 EP filed Jul. 14, 2011, the entire contents of which is hereby incorporated herein by reference.

FIELD OF INVENTION

The present invention relates generally to a turbomachinery blade design and, more specifically, to an optimised profile of a blade root and/or a rotor disc.

BACKGROUND OF THE INVENTION

A turbine section of a gas turbine typically has a plurality of rows of stationary vanes and rotary blades. The blades of one row are usually identical to each other and include an aerofoil portion, a platform portion, and a root portion. Some blade rows may additionally include a shroud portion preventing the hot gases escaping over the blade tip. The root portion is the most radial inward section of the blade and is used to mount the blade in a mounting groove or slot provided in a rotor disc. Typically for each rotor blade a corresponding mounting groove is provided. The blades are particularly assembled by axially sliding each root portion into the corresponding groove.

It is known for turbine blades to be fitted to turbine discs by means of cooperating firtree profiles. Such fixing methods provide accurate location of the blade with respect to the disc. Firtree profiles are sufficiently strong to withstand the radially outward—centrifugal—forces imposed on the blade during rotation of the disc and its attached blades in operation of the turbine engine in which it is installed. In operation, flanks of the firtree profiles of the blades which face away—in a slanted manner—from an engine axis and which are in contact with opposite firtree profiles of the grooves, support the blades against radially outward movement, and can be regarded as loaded flanks. The oppositely facing flanks of the profiles can be regarded as unloaded flanks, since they do not support any significant radial forces in operation.

Conventional shape of a turbine blade firtree root is defined using straight lines and circular arcs only, when looked a sectional view of the blade root, the sectional view defined by a plane perpendicular to the rotor axis of the turbine. Such a shape is optimised against a number of geometric and mechanical constraints.

The flanks of the profiles are interconnected by transition regions which are alternately convex surfaces, which are usually but not always arcuate and are referred to as fillets or necks, and concave surfaces, which are usually but not always arcuate and are known as corners or lobes or teeth or lugs. The fillets are typically regions of high stress concentration.

Conventionally, firtree profiles on turbine blade roots may be formed in a grinding process.

The basic firtree root configuration contains multiple potential load paths, with the magnitude of the resulting stresses therein dependent upon the precision of the initial fit between the blade root and the corresponding groove in the disc. These stresses occur during operation caused by centrifugal forces affecting the blades—the centrifugal load being dependent on the mass of the whole blade—and are of particular concern for such potential failure as fatigue or stress corrosion cracking. The life or the number of operation cycles of the blade may be limited.

A root may be substantially mirror-symmetrical. The root comprise a pair of symmetrical uppermost necks or fillets which extends downwardly from a lower surface of a platform and form a recess in circumferential direction, a pair of uppermost lugs or lobes which extend downwardly from the uppermost necks and form a projection in circumferential direction. A plurality of symmetrical pairs of necks and lobes may follow downwardly in alternating order. The root portion will end via a pair of symmetrical lowermost necks followed by a pair of symmetrical lowermost lobes. Surfaces of the pair of lowermost lobes will converge and will be joined at a most downward location via an arcuate or flat surface, the root bottom.

Patent publications EP 0431766, GB 2,343,225, EP 0478234, JP 59113206, DE 3236021, EP 1048821, GB 2380770, EP 0889202, U.S. Pat. No. 5,554,005, US 2008/0298972, among others, show different kinds of blade root profiles, substantially all focusing on stresses in different areas of the blade root, all directed to optimise the blade root for different types of machines, for different sizes of blades, and/or for different operating speeds. Still, it is a goal to reduce high level of stresses in contact points between the blade and a corresponding disc at which the blade is mounted.

SUMMARY OF THE INVENTION

This objective is achieved by the independent claims. The dependent claims describe advantageous developments and modifications of the invention.

In accordance with the invention there is provided a blade root comprised of a plurality of lobes and fillets and flanks in between, in which a soft shoulder is provided between the flanks and the fillets to increase the distance to a corresponding lobe of a rotor disc, into which a blade with such a blade root is inserted. The invention is also directed to rotor blade having such a blade root. Furthermore this feature may alternatively or additionally also be applied to a rotor disc slot of a rotor disc, such that a flank of the rotor disc slot merges into a fillet of the rotor disc via a soft shoulder to increase the distance to a corresponding lobe of a blade root.

The effect of such a shoulder—the shoulder comprising an internal and external radius of the fillet adjacent to each other—with its adjacent internal and external fillet radii acted upon by a centrifugal loading of a blade during operation is to induce a compressive stress in the external radius at the end of contact. This helps negate tensile stresses that would be set up by friction at this interface.

To define the invention in more detail, one aspect of the invention is directed to a blade root, particularly of a turbine blade, comprising a plurality of opposite pairs of lobes, a plurality of opposite pairs of fillets, a bottom of the blade root, and a plurality of flanks, wherein the lobes and the fillets are arranged in an alternating order and each of the flanks is arranged between one of the lobes and one of the fillets. Each of the pair of lobes is arranged substantially mirror-symmetrical and each lobe comprises a convex lobe surface section. Each of the pair of fillets is arranged substantially mirror-symmetrical and each fillet comprises a concave fillet surface section. A first flank of the plurality of flanks facing away from the bottom has a first planar surface section—i.e. a flat surface, even under zero loading, and without protrusions or grooves. According to the invention this first planar surface section is adjacent to—and/or transforms into—a convex surface section. The first planar surface section is the part of the blade root that will be in contact with a corresponding disc slot flank during operation due to centrifugal load. The first planar surface section is located in a (fictitious) first plane. The convex lobe surface section is adjacent to—and/or transforms into—the first planar surface section. The concave fillet surface section is adjacent to—and/or transforms into—the convex surface section. According to the invention the convex surface section and a region of the concave fillet surface section adjoining the convex surface section form a local recess—i.e. an indention, a depression—in respect of the first plane.

In other words, the convex surface section and a region of the concave fillet surface section adjoining the convex surface section form an undercut. The undercut is arranged such that the distance to a corresponding opposite surface of a rotor disc, when assembled together, increases rapidly due to the convex surface section. A gap is formed between the two mentioned surfaces of the blade root and the rotor disc in the region of the fillets of the blade root.

With the term "opposite" pair of lobes two lobes are meant that are mirror symmetrical to each other and define surfaces which face in diametric directions. The same applies to opposite pair of fillets, flanks, etc. accordingly.

As said, the flanks, particularly the first flank, may be angled surfaces, each surface facing substantially away from the bottom of the blade root and may define a bearing or contact surface area at which a corresponding surface of a rotor disc—particularly a turbine disc—is in contact during operation of rotating machine in which the blade with its blade root is equipped. The flanks may particularly be radially outer flanks with respect to an axis of rotation if the blade root is inserted in a rotor disc which is rotatable about the axis.

In a first embodiment, the bearing surface expanse may increase for flanks that are closer to the bottom of the root. This is beneficial as load is distributed which may reduce the level of stress during operation in the area of contact between the blade root and the disc in which the blade is equipped. The lifetime of the blade root will increase, particularly the low cycle fatigue life.

The invention may preferably be directed to an arrangement with three pair of lobes, three pairs of fillets and three pairs of flanks in between.

If the second flank is considered to the intermediate flank and a third flank to be the closest to the bottom, than the planar expansion of the second flank and the third flank may be identical. Alternatively, a third planar expansion of the third flank may be greater than the second planar expansion of the second flank. Particularly, the second planar expansion may be 25%-50% greater than the first planar expansion. In a very preferred embodiment, the second planar expansion may be substantially 33% greater than the first planar expansion.

The surfaces of the fillets may be substantially sections of cylinders, possibly even elliptic cylinders. A radius of the cylinder may be called fillet radius. One fillet may be defined by a section of one cylinder. Alternatively more complex surface structures are possible in which several parts of surfaces can be defined, for which each part of the surface is defined by a fillet radius. According to a preferred embodiment of the invention, a first fillet radius of a first fillet of the plurality of fillets may be arranged at a most distant position in regards to the bottom of the blade root, a second fillet radius of a second fillet of the plurality of fillets may be arranged at a closer—e.g. intermediate or bottom—position in regards to the bottom of the blade root, and the first fillet radius may be substantially equal to the second fillet radius. Preferably all fillet radii of the fillets may be identical as this may reduce points of stress.

The inventive local recess may particularly be formed such that the convex surface section increases an orthogonal distance to the first plane—i.e. the distance to the fictitious plane if the distance is measured perpendicular to the first plane—in direction from its first end at which the convex surface section merges into first planar surface section to its second end at which the convex surface section merges into the concave fillet surface section. Thus a gap is formed and widened between the corresponding surfaces of the blade root and the rotor disc by the specific saddle like configuration of the combination of the convex surface section and the adjacent section of the concave fillet surface section.

In a further embodiment, the convex surface section may merge into the first planar surface section with a smooth transition, in particular by a smooth shoulder, i.e. without a rim or a without a sharp bend or kink. The same applies to the convex surface section at the location where it merges into the concave fillet surface section.

In another embodiment, the firtree narrows in width from a platform region to the bottom of the blade root. Particularly, assuming each of the pair of lobes comprises most distal surface sections defining a widest distance between opposite surfaces of the pair of lobes then the widest distance between opposite surfaces of the pair of lobes may be shortest for the pair of lobes closest to the bottom of the blade root and increases for each pair of lobes with larger distance to the bottom. Additionally or alternatively, assuming each of the pair of fillets comprising minimum distant surface sections defining a narrowest distance between opposite surfaces of the pair of fillets then the narrowest distance between opposite surfaces of the pair of fillets may be shortest for the pair of fillets closest to the bottom and increases for each pair of fillets with larger distance to the bottom.

According to a further embodiment, the two fillets closest to the bottom may be configured substantially similar to each other. Considering a first fillet radius of a first fillet of the plurality of fillets being arranged at a closest first position in regards to the bottom of the blade root and a second fillet radius of a second fillet of the plurality of fillets being arranged at a more distant second position in regards to the bottom of the blade root compared to the first position. Then, the first fillet radius may be substantially equal to the second fillet radius.

Generally, a blade root may have a particular cross section and may have an identical cross section throughout the length of the blade root. Along its length, the blade root may be straight or may follow a steady curve, the curve having a design that it can be inserted in a corresponding slot without tilting. The end faces of the blade root may look like the cross section. The side faces of the blade root are formed by the lobes, fillets, flanks, and the bottom of the blade root, as previously explained. Particularly, the plurality of opposite pairs of lobes and the plurality of opposite pairs of fillets may form substantially two corrugated edgeless surfaces, the surfaces particularly being symmetrical to a plane of symmetry and particularly being continuously progressing away from the bottom free of overhangs and free of surfaces perpendicular to the plane of symmetry, like steps or apexes.

In yet another embodiment, the previously discussed configuration may be shown by the blade root once manufactured or under zero loading. Additionally this configuration is also present when loading occurs during operation. Particularly, the first planar surface section may be a flat surface under no loading.

The shape of the surfaces during operation may depend on the material used. Particularly the material that may be used is a non-deformable, non-elastic material, a rigid material. It may be non-deformable in relation to the expected forces that are acting upon the surface during operation.

Besides, the invention is also directed to a blade which may be provided for a rotating machine, like a turbomachine, e.g. particularly a turbine blade for a gas or a steam turbine. The blade comprises an aerofoil, a platform from which the aerofoil extends upwardly and a blade root that extends downwardly, the blade root for attaching the blade to a rotor in a groove or slot of the rotor, e.g. a rotor disc. The blade root is configured according to any of the embodiments as previously discussed above.

Furthermore the invention is also directed to a turbomachine assembly, particularly for a turbine, e.g. a gas or steam turbine, comprising a disc with a plurality of slots and a plurality of blades with blade roots as defined previously, each inserted into the plurality of slots. The slots and the blades are arranged such that during operation areas of contact—bearing surfaces—between a surface of the slots and a surface of the blades is limited to the plurality of substantially planar surface sections of the blade roots.

The concept of this invention may also be applied additionally or alternatively to slots of a rotor disc. In the following a rotor disc is defined and explained in more detail. Even though not discussed in full detail as before in regards to the rotor blade, all embodiments explained above for the blade root may also be applied accordingly for the slot of a rotor disc.

According to an aspect of the invention, a rotor disc, particularly for mounting turbine blades, comprises a plurality of disc slots, each of the plurality of disc slots further comprises:

- a plurality of opposite pairs of slot lobes, each of the pair of slot lobes being arranged substantially mirror-symmetrical and each slot lobe comprising a convex slot lobe surface section;
- a plurality of opposite pairs of slot fillets, each of the pair of slot fillets being arranged substantially mirror-symmetrical and each slot fillet comprising a concave slot fillet surface section;
- a plurality of slot flanks, wherein the slot lobes and the slot fillets are arranged in an alternating order and each of the slot flanks is arranged between one of the slot lobes and one of the slot fillets;
- a bottom of the disc slot;

wherein a first slot flank of the plurality of slot flanks facing substantially towards to the bottom has a second planar surface section, which is adjacent to a convex transition surface section, the second planar surface section being located in a first plane—which is substantially identical to the previously defined first plane for the blade root; and wherein the convex slot lobe surface section is adjacent to the second planar surface section; and wherein the concave slot fillet surface section is adjacent to the convex transition surface section; and wherein the convex transition surface section and a region of the concave slot fillet surface section adjoining the convex transition surface section form a local recess in respect of the first plane.

The local recess particularly forms a parallel translation of the first planar surface section, like a step leading to an offset.

The invention is also directed to a turbomachine assembly, comprising a rotor disc with a plurality of disc slots and a plurality of blades equipped in the slots. The turbomachine assembly may comprise blades with inventive blade roots as discussed before. The rotor disc slots may not have a local recess in one embodiment. The first planar surface section may be the bearing surface when in operation. Alternatively, the rotor disc slots may have a local recess in another embodiment as discussed above but the blade roots do not show such a feature. The second planar surface section may be the bearing surface when in operation.

As a last configuration, both the rotor disc slots and the blade roots may both show local recesses as discussed above. Preferably first planar surface section and the second planar surface section will be substantially perfect mating surfaces and are bearing surfaces during operation.

As previously said, this invention is directed to mount parts intended to be rotated about an axis to a part that carries the mounted part. This applies for examples for rotor blades in steam turbines or gas turbines. The invention may in principle also be used in other rotating machines, like motors or compressors. Besides, the inventive blade root can also be used for mounting non-rotating stator vanes, even though the problem with centrifugal forces does not exist for non-rotating devices.

It has to be noted that embodiments of the invention have been described with reference to different subject matters. In particular, some embodiments have been described with reference to apparatus type claims whereas other embodiments have been described with reference to methods. However, a person skilled in the art will gather from the above and the following description that, unless other notified, in addition to any combination of features belonging to one type of subject matter also any combination between features relating to different subject matters, in particular between features of different apparatus type claims or between features of apparatus type embodiments and embodiments referring to methods is considered as to be disclosed with this patent application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematical. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation. In general the invention may be applied to other types of machines that provide a rotational movement about an axis of rotation and at which rotating parts need to be connected to a carrier element this executing a rotational movement about the axis, so that centrifugal forces effect the rotating parts. Particularly this technology may be applied to gas turbines engines or steam turbines engines. In regards of gas turbine engines, the invention may be applied to rotor blades within a turbine section and/or within a compressor section.

DETAILED DESCRIPTION OF THE INVENTION

Figure 1:
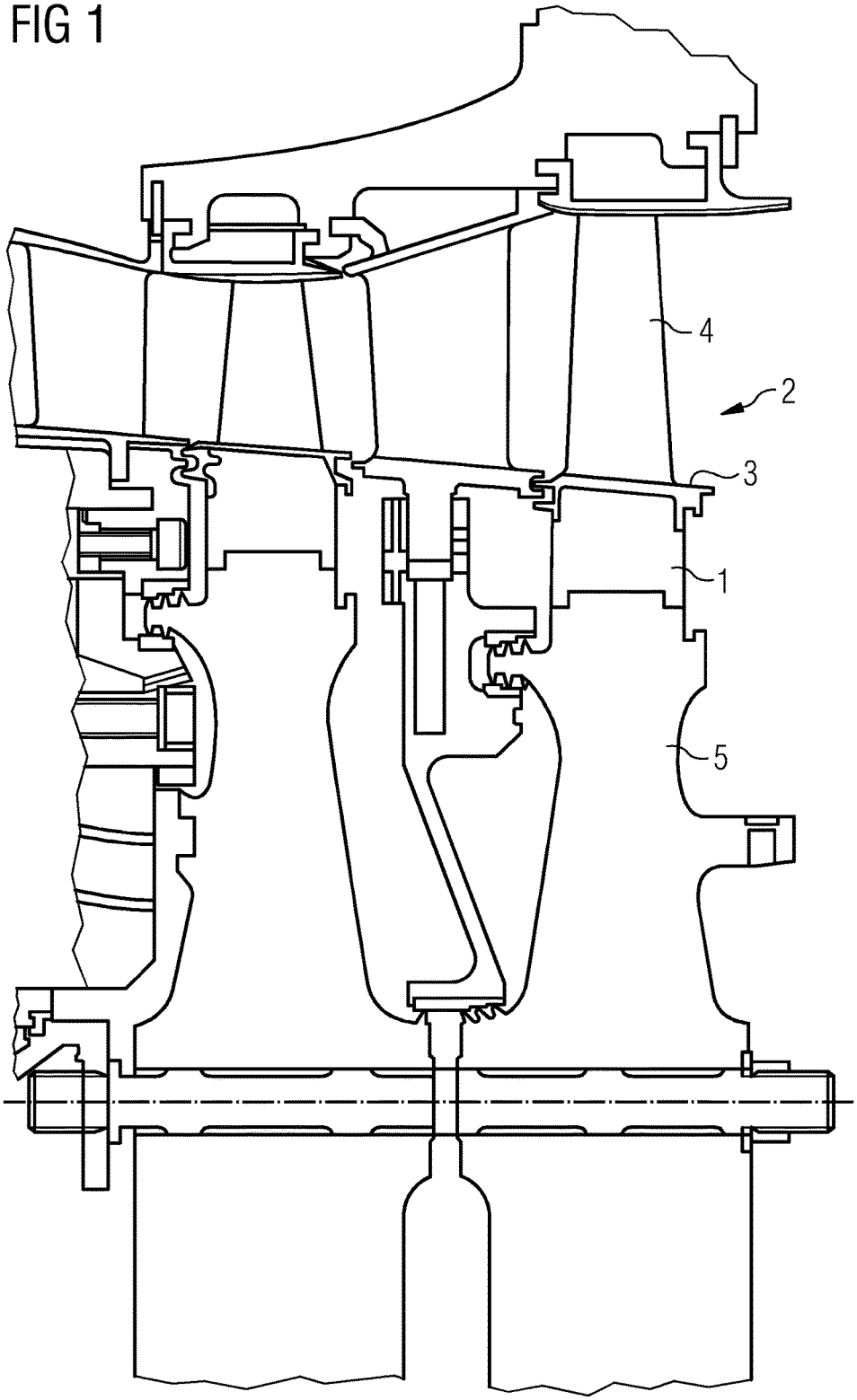
FIG. 1: shows schematically a part of a turbine section of a gas turbine in a cross sectional view.

Referring now to FIG. 1, a part of a turbine section of a gas turbine is depicted in a cross sectional view along an axis of rotation. Two stator vanes and two rotor blades are shown alternating. Rotor blade 2 comprises an aerofoil 4, a platform 2 and a blade root 1. The rotor blade 2 is inserted via its blade root 1 into a slot of a rotor disc 5. The slot and the rotor disc 5 are formed correspondingly such that the rotor blade 2 and further rotor blades are held in position during rotation of the rotor disc 5. Particularly it is important that the rotor blade 2 is held in position when affected by centrifugal forces due to high rotational speeds of the rotor disc 5.

Figure 2:
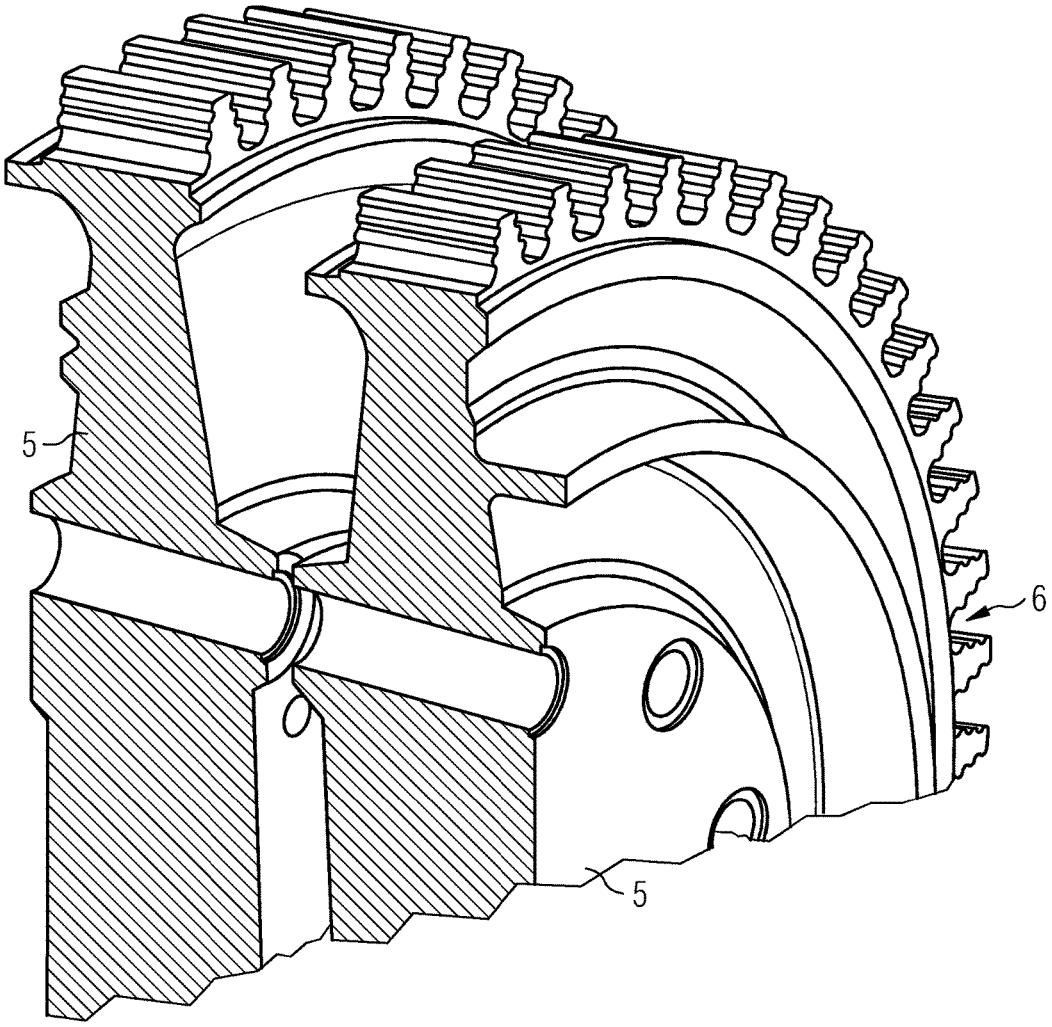
FIG. 2: illustrates rotor discs in a perspective view.

To withhold the rotor blade 2 in its position, the slots will typically be serrated, as it can be seen in FIG. 2.

Throughout this document, an axial direction is defined along an axis of rotation of a rotor. In FIG. 1 the axial direction will be in the drawing plane and will be from left to right. A radial direction will also be in the drawing plane and will be orthogonal to the axial direction, e.g. from the blade root 1, to a blade platform 3 and further to the aerofoil 4. Orthogonal to the radial and the axial direction a circumferential direction can be defined.

According to FIG. 2, two rotor discs 5 are shown partially from a perspective view without its corresponding blades. A plurality of slots 6 are shown at a radially outer region of the discs 5. Each slot is designed such that they are shaped as a firtree to allow a blade with a firtree shaped root.

Figure 3:
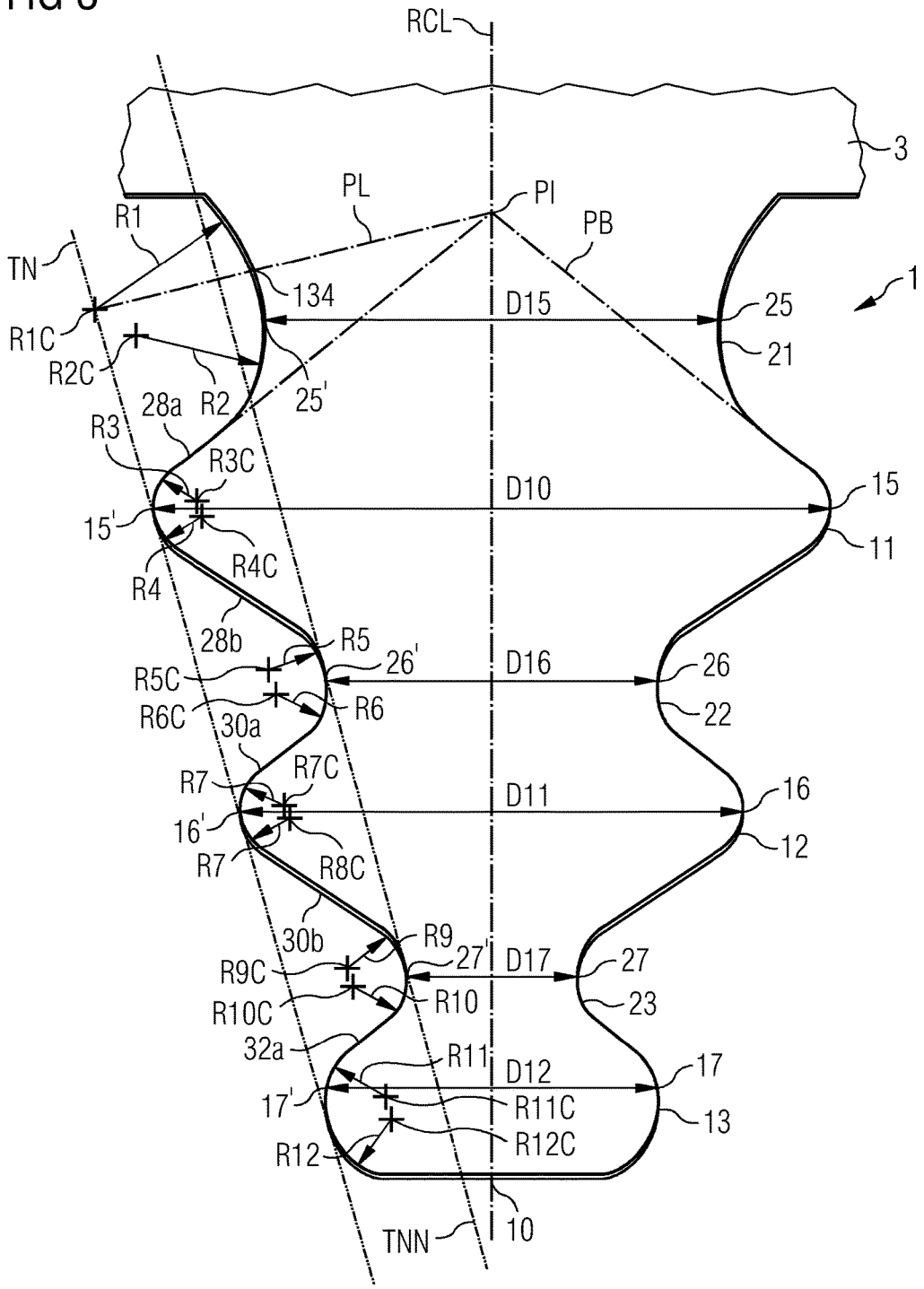
FIG. 3: shows a firtree shaped root of a prior art blade in a cross-sectional view.

Features and terminology of a firtree shaped root of a prior art blade are explained in reference to FIG. 3, which shows a cross-sectional view of a known blade root. The cross section is given in a radial plane of the rotor disc, showing particularly the firtree design of the blade root and the corresponding firtree design of the rotor disc.

In reference to FIG. 3, the two-dimensional shape of a blade root in a cross sectional view as it can be seen from an axial direction can be described using a set of straight lines and circular arcs. The full three-dimensional body may substantially be an axial projection of this shown two-dimensional cross-sectional shape.

A root 1 of a blade includes in descending order radially inwards—as seen from a radial outward end of the root that is directed to a platform of the blade—an upper-most root neck or fillet 21, at least one intermediate neck or fillet 22, and a lower-most neck or fillet 23. Each fillet is formed symmetrically about a root centre line RCL by a pair of mirror-image curved surfaces having a unique shape which will be described in more detail below. Each minimal distant points of a pair of mirror symmetrical fillets are indicated as minimum distant surface sections 25, 26, 27 with its symmetrical minimum distant surface sections 25', 26', 27'. The distance between a pair of minimum distant surface sections 25-25', 26-26' and 27-27' has a width indicated by the horizontal lines D15, D16 and D17 for the upper-most fillet 21, intermediate fillet 22, and lower-most fillet 23, respectively.

The minimum distant surface section may also be called a bottom or trough. The distance will be measured perpendicular to the plane of symmetry.

An upper-most lug or lobe 11 is formed beneath the uppermost fillet 21 and is also symmetrically disposed about the root centre line RCL. An intermediate lug or lobe 12 is disposed beneath the intermediate fillet 22. A lower-most lug or lobe 13 is disposed beneath the lowermost fillet 23.

Each maximum distant points of a pair of mirror symmetrical lobes are indicated as most distal surface sections 15, 16, 17 with its symmetrical most distal surface sections 15', 16', 17'. The distance between a pair of most distal surface sections 15-15', 16-16' and 17-17' has a width indicated by the horizontal lines D10, D11 and D12 for the upper-most lobe 11, intermediate lobe 12, and lower-most lobe 13, respectively.

The most distal surface section may also be called a peak, cusp, or crest. The distance will be measured perpendicular to the plane of symmetry.

The upper-most fillet 21, on each side of the root centre line RCL, has a compound radius wherein a first radius R1 has a pivot centre R1C so as to define a surface which extends from the platform portion 3 to a point of transition 134. At point 134, a second radius R2 is used to complete the fillet surface by drawing a curve from a pivot centre R1C spaced inwardly of the pivot centre R1C.

The pivot centre R1C lies on a line TN which is tangent to the outer radial surfaces of the root lobes 11, 12 and 13. The point 134 of transition from the first radius to the second radius is selected by drawing a perpendicular line PL from the tangent TN and passing through a point PI of intersection on the root centre line RCL wherein planes PB which include the bearing surfaces of the uppermost lobe intersect each other and the root centre line RCL.

Each lobe of the blade root has a flat, upper bearing surface, such that the lobe 11 has a bearing surface 28*a*, the lobe 12 has a bearing surface 30*a* and the lobe 13 has a bearing surface 32*a*. In the upper-most lobe 11, the bearing surfaces on opposite sides of the root centre line RCL intersect at the RCL and thus provide a reference point for the perpendicular line PL which provides the point of transition 134 between the first and second radii of the upper-most fillet 21.

For the remaining lobes and fillets, a single radius may be used at staggered pivot centres. For example, the outer radial extension of lobe 11 may be formed by two radius segments of radius R3 and R4. R3 and R4 may be equal to each other, but possibly the pivot centres R3C and R4C are staggered vertically so as to produce a flattened surface portion between the two radius portions formed by the two radii of equal length.

There may also be a flattened surface 28*b* facing substantially radial inwards that extends from the lobe 11 to the fillet 22. A further flattened surface 30*b* may be present between the lobe 12 and the fillet 23.

According to the drawing the lower-most lobe 13 has a flat bottom surface. The bottom is indicated by reference numeral 10.

Based on this introduced terminology, embodiments of the invention are described in reference to the following figures.

Figure 4:
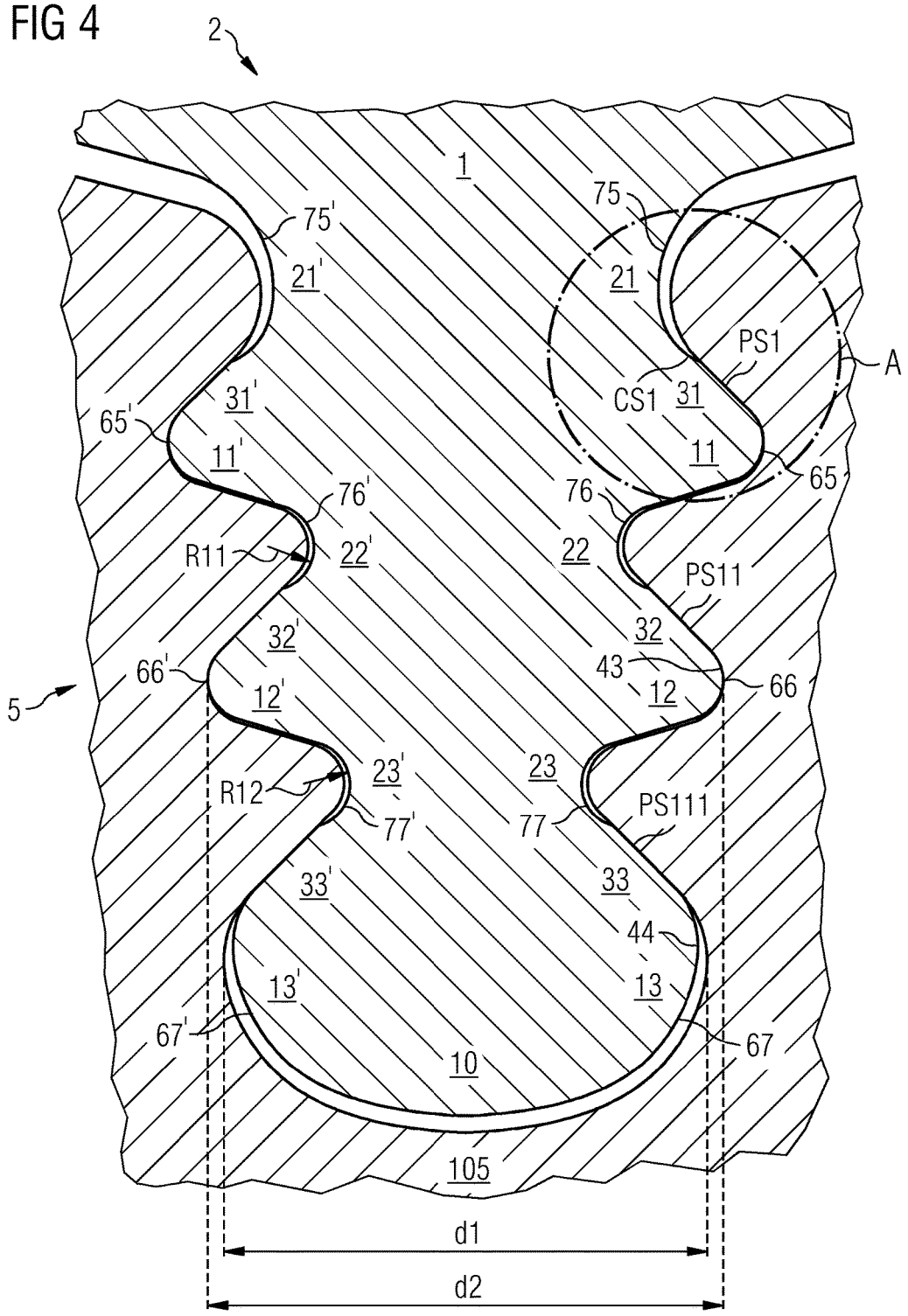
FIG. 4: shows a firtree shaped root of an inventive blade and a corresponding disc in a cross-sectional view.

According to FIG. 4, a firtree shaped blade root 1 of an inventive blade is shown in a cross-sectional view including a section of a firtree of a rotor disc 5 showing a slot, at which the blade is inserted. The cross section is given in a radial plane of the rotor disc 5 or as it could be seen when facing the rotor disc 5 from an axial view, considering the rotor disc 5 will be rotating about an axis during operation.

As FIG. 4 shows a similar design as the blade root 1 shown in FIG. 3, most reference numerals still apply for FIG. 4 without modification. Already introduced elements may not be repeated again, as the previous said may be applied also to FIG. 4.

Before coming into detail, a main difference between FIG. 4 and FIG. 3 is that in the regions of the fillets 21, 22, 23, 21', 22', 23' of the blade root 1, the surface may not be in bearing contact with the corresponding lobes of the rotor disc. By this, stress may be reduced and lifetime of the blade may be exceeded.

In respect of the following explanation, "upper" or "upward" may indicate a position of the blade root 1 closer to the blade platform 3 or closer to the aerofoil 4. "Lower", "downward", or "descending" means the opposite direction, away from the blade platform 3 along the blade root 1 to a bottom 10 of the blade root 1. The lowest part of the root 1 will be called bottom 10 throughout this document. Once assembled to the disc 5 which is rotatable about a rotational axis, the root centre line RCL (as indicated in FIG. 3) of the blade root 1 is directed in radial direction. The bottom 10 is closer to the rotational axis than the other parts of the blade root 1. Thus, "radially outwards" corresponds to the "upward" direction, "radially inwards" defines the opposite direction.

The depicted blade root 1 is mirror symmetrical to a plane that can be indicated by the root centre line RCL (as shown in FIG. 3). Mirror symmetric elements will typically be mentioned with the same reference numeral followed by an apostrophe (').

The blade root 1 comprises a bottom 10, a plurality of opposite pairs of lobes, and a plurality of opposite pairs of fillets. Starting at an upward end of the root 1 near the platform and then proceeding downwards, the surface on one side of the root is formed by a first fillet 21, followed by a first lobe 11, further a second fillet 22 (intermediate fillet), continuing to a second lobe 12, followed by a third fillet 23 and a third lobe 13 (which is part of a bottom bulb-like root end and merges to the bottom 10). Finally the discussed surface is meeting the opposite surface at the bottom 10.

The opposite surface is identically formed, as it is symmetrical to the just defined surface. The same order applies to this opposite surface, i.e. a first fillet 21' near the platform, followed by a first lobe 11', a second fillet 22', a second lobe 12', a third fillet 23' and a third lobe 13'. Both surfaces will be closed at the bottom 10.

A distance can be taken between mirror symmetrical points on the opposite surfaces. A largest distance between surface areas of the pair of opposite first lobes 11, 11' is given by a first width D10 (see FIG. 3). The surface areas with the largest distance are indicated as most distal surface sections 15, 15' (see FIG. 3). Similarly, most distal surface sections 16, 16' (see FIG. 3) define the largest surface distance—second width D11 (see FIG. 3)—between the pair of opposite second lobes 12, 12'. Furthermore, a third width D12 (see FIG. 3) is indicated between most distal surface sections 17, 17' (see FIG. 3), which have the widest distance between the two surfaces in the area of the lobes 13, 13'.

As it can be seen in the FIG. 4 regarding the width between lobes 11, 11', 12, 12', 13, 13' of the blade root 1, the first width D10 is wider than the second width D11. The smallest width is the third width D12.

Similar to the lobes 11, 11', 12, 12', 13, 13' also distances between the fillets 21, 21', 22, 22', 23, 23' can be defined. Again, some of the details will be explained according to FIG. 4, but reference signs can only be seen in FIG. 3. A shortest distance between surface areas of the pair of opposite first fillets 21, 21' is indicated as first width D15. The surface areas with the shortest distance are indicated as minimum distant surface sections 25, 25'. Similarly, minimum distant surface sections 26, 26' define the shortest surface distance—second width D16—between the pair of opposite second fillets 22, 22'. Furthermore, a third width D17 is indicated between minimum distant surface sections 27, 27', which have the shortest distance between the two surfaces in the area of the minimum distant surface sections 23, 23'.

As it can be seen in FIG. 3—and similarily in FIG. 4 even though the reference signs are not shown in FIG. 4—regarding the width between minimum distant surface sections, the first width D15 is wider than the second width D16. The smallest width is the third width D17.

Applicable to the embodiments of FIG. 3 and/or FIG. 4, all minimum distant surface sections 25, 26, 27 of one surface side may lie within a single fictitious planar plane. The same applies to FIG. 4, even though the reference signs 25, 26, 27 are not mentioned in the figure for the minimum surface sections for the fillets 21, 21', 22, 22', 23, 23'. Obviously the same applies for the mirror symmetrical surfaces of the firtree. Also, all most distal surface sections 15, 16, 17 of one surface side may lie within a further single fictitious planar plane. Again, the same applies to FIG. 4, even though the reference signs 15, 16, 17 are not mentioned in the figure for the most distal surface sections for the lobes 11, 11', 12, 12', 13, 13'.

A tangent to one side of the root surfaces may be constructed on which all lobe surfaces of one root side may lie (see tangent TN in FIG. 3). Additionally also a tangent to one side of the root surfaces could be constructed on which all or at least two fillet surfaces of one root side may lie (see tangent TNN in FIG. 3).

The blade root 1 can be defined further that the minimum distant surface sections 25, 25' have a distance to the bottom 10 which is greater than the distance of the minimum distant surface sections 26, 26', which is again greater than the distance of the minimum distant surface sections 27, 27'.

As it can be seen, lobes 11, 11', 12, 12', 13, 13' and fillets 21, 21', 22, 22', 23, 23' are arranged in an alternating manner. There are transition areas in between. The transition areas of the blade root surface that face tilted in direction to the blade platform and face away from the bottom 10 of the root 1 and that will be in contact to an corresponding surface of the slot 6 of the disc 5 is indicated as flank 31, 31', 32, 32', 33, 33'. The flanks 31, 31', 32, 32', 33, 33' are substantially planar and are bearing surfaces. In downward direction starting from the platform and focusing only on one surface side, the first fillet 21 is followed by a first flank 31, which then merges to the first lobe 11. The second fillet 22 merges via a second flank 32 to the second lobe 12. Finally, the third flank 33 defines a transition area between the third fillet 23 and the third lobe 13. The same applies to the symmetrical surface showing the flanks 31', 32', 33' opposite the flanks 31, 32, 33.

The first flank 31 comprises a first planar surface section PS1 with a first planar expansion. The first planar expansion is substantially in form of a rectangular with one dimension that can be seen in the cross sectional view of FIG. 4 and the other dimension being the axial length of the blade root 1.

The further flanks also each have a planar surface section with a planar expansion but in the following all explanation is given for the first flank 31.

According to the embodiment the planar expansion of the most downward flank 33 may be greater than the planar expansion of the mid flank 32, which again may be greater than the planar expansion of the most upwards flank 31. Alternatively, the planar expansion of the two most lower flanks 32, 33 may be identical.

As the planar expansions indicate the bearing surfaces, it is understood that via the second flank 32 having a larger expansion than the first flank 31, less stress may occur in the root.

Centrifugal forces during operation are withheld via the flanks 31, 31', 32, 32', 33, 33'. Other surfaces may be in direct contact with the slot 6 of the disc 5 but may not be considered a bearing surface. Additionally in some parts there may even be a gap between a surface of the slot 6 and a surface of the blade root 1.

In FIG. 4 also fillet radii are indicated as R11 and R12. It may be considered a simplification of the fillets only follow one section of circular cylinder or of an elliptic cylinder. The fillet may be composed of several sections which can be defined via fillet radii, as it is shown in FIG. 3. Nevertheless in a preferred embodiment, the two mentioned fillet radii R11 for the medium fillet 22, 22' and R12 for the lower fillet 23, 23' of all fillets are substantially identical.

Figure 5:
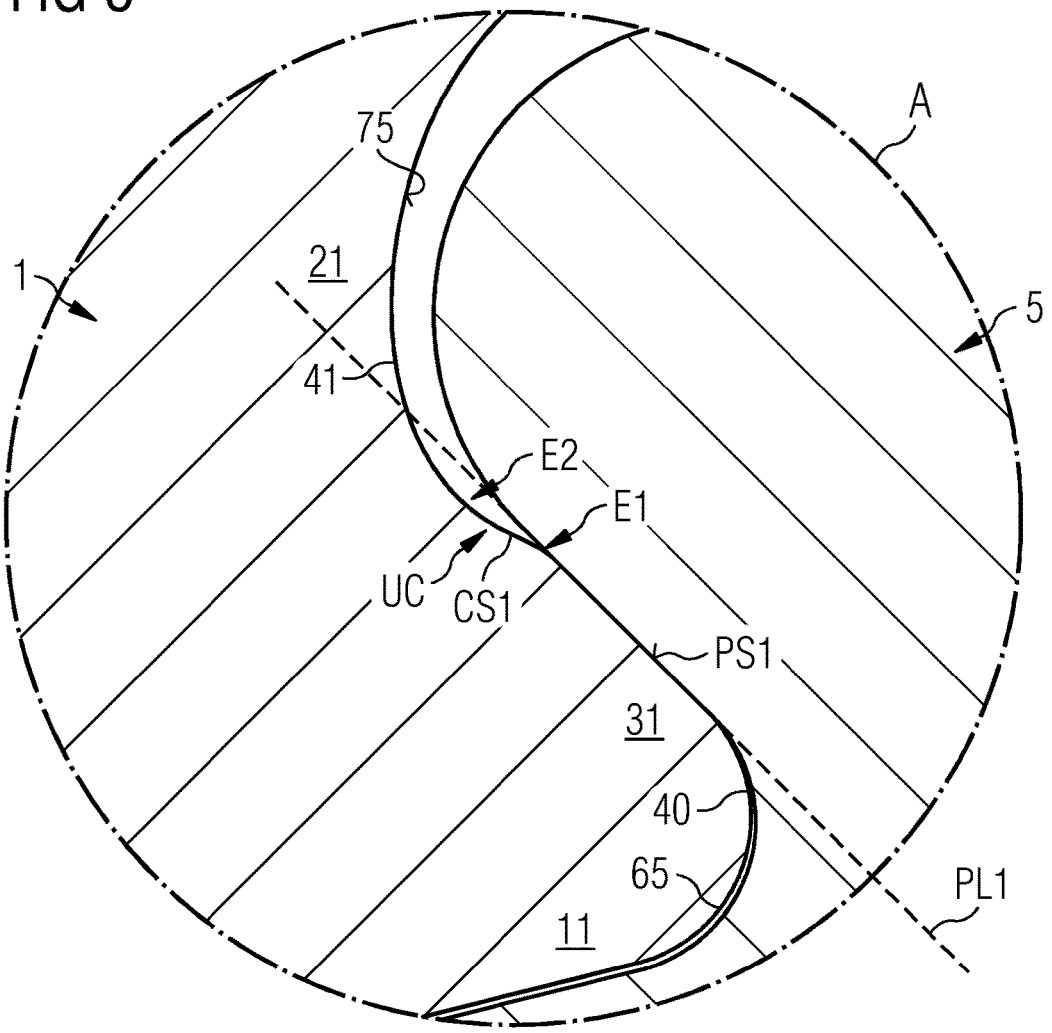
FIG. 5: shows an enlarged area of the inventive blade of FIG. 4.

Corresponding to FIG. 4, the area indicated with A is highlighted in more detail in FIG. 5. All previously said will apply not only to the lobe 11, the first flank 31, and the fillet 21, as shown in FIG. 5, but may apply accordingly to the other lobes, fillets, and flanks.

According to FIG. 5, in upward direction, the blade root 1 comprises the lobe 11 with a convex lobe surface section 65, a first flank 31 with a first planar surface section PS1, and the fillet 21 with a concave fillet surface section 75. According to an embodiment of the invention, the convex lobe surface section 6 is directly adjacent to and merges into the first planar surface section PS1, whereas a transition section is located between first planar surface section PS1 and the concave fillet surface section 75. This transition section comprises a local recess—or undercut—UC, which is created by a convex surface section CS1 and a downward end region of the concave fillet surface section 75.

In fact, the first planar surface section PS1 turns smoothly away from a first plane PL1 in which the first planar surface section PS1 is located such that the convex surface section CS1 is formed. From a first end E1 of the convex surface section CS1 in upward direction, the surface of the blade root 1 will increase the distance to the first plane PL1. The convex surface section CS1 will flatten and merge into the concave fillet surface section 75 at a second end E2—a line of inflection—of convex surface section CS1.

The expanse of the convex surface section CS1 is particularly only a fraction of the expanse of the concave fillet surface section 75, the first planar surface section PS1, or the convex lobe surface section 65. The radius of a cylinder defining the convex surface section CS1 is equal or greater than the radii of the concave fillet surface section 75 or the convex lobe surface section 65.

By these surface features of the blade root 1, an overall inflected profile is created, so that a distance to a corresponding rotor disc surface is increased. A shoulder is defined by the convex surface section CS1 starting from which—in upward direction—the corresponding surfaces of the blade root 1 and the rotor disc 5 will not be in bearing contact. The bearing is limited to the first planar surface section PS1.

According to this embodiment, a slot of a rotor disc 5 may have a simple profile, that a concave fillet surface is followed by a planar surface and again by a convex lobe surface. The surface of the slot does not have a local recess or shoulder like the blade root 1 (see undercut UC).

The centrifugal load of the blade acting radially outboards of a bearing interface according to the prior art typically would cause a local high stress to be set up at the edge of the interface, or the restraint, referred to as the edge of bedding stress. This stress has been known to cause fatigue failures of blade roots in which cracking normal to the root flank face and emanating from the edge of contact is evident. According to the improved design as explain above, the effect of the adjacent internal and external fillet radii acted upon by the centrifugal loading of the blade is to induce a compressive stress in the external radius form at the edge of contact—near the first end E1 of the convex surface section CS1. This helps negate tensile stresses would set up by friction. This may have the side effect of increasing the tensile stresses in the internal fillet radius, but these may tend to be significantly lower than the edge of bedding stress.

Again the given design has the advantage that it is possible to manufacture this profile using conventional methods, e.g. creep feed grinding or broaching process.

The inventive idea of FIGS. 4 and 5 can also be applied to rotor discs such that a slot 6 of a rotor disc 5 is optimised. In such an embodiment—explained further in reference to FIG. 6—you could roughly say that the features are applied point symmetrically—when seen in a cross sectional view—compared to the previous embodiment such that now the slot surface comprises a shoulder to form a local recess and that the blade root 1 does not form such a local recess.

Figure 6:
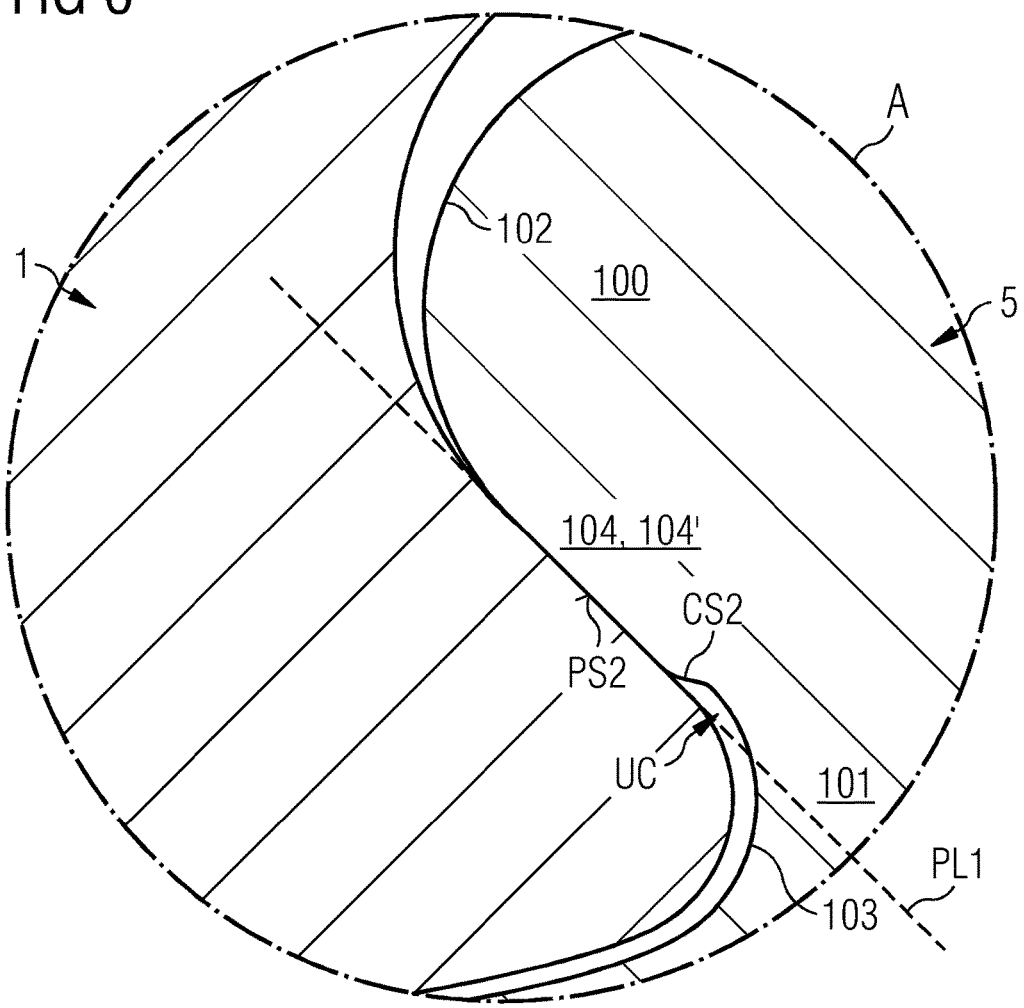
FIG. 6: shows an enlarged area of an alternative inventive disc.

According to FIG. 6 the blade root 1 has a simpler design as before, such that the convex lobe surface section 65 is followed by first planar surface section PS1 and again directly by the concave fillet surface section 75. The surface of the blade root 1 does not have the convex surface section CS1, the local recess or the shoulder like the blade root 1 of the previous embodiment of FIGS. 4 and 5.

The rotor disc 5 comprises a plurality of disc slots 6 for mounting turbine blades, each disc slot 6 comprising a plurality of opposite pairs of slot lobes and a plurality of opposite pairs of slot fillets. In the following only one specific slot lobe 100 and one specific slot fillet 101 is discussed in reference to FIG. 6. The features to be discussed could be applied for example for the region highlighted by reference sign A in FIG. 4. The slot lobe 100 defines a convex slot lobe surface section 102 that merges into a second planar surface section PS2 of a first slot flank 104'. The flank 104' that is discussed is a bearing surface and is facing substantially towards to a bottom 105 (see FIG. 4) of the disc slot 6. According to the invention the second planar surface section PS2 merges into a concave slot fillet surface section 103 of the slot fillet 101 via a transition part that forms a local recess UC (or undercut) in the surface of the disc slot 6. In particular, in downward direction, the second planar surface section PS2 is followed by a convex transition surface section CS2, wherein the latter merges smoothly into the concave slot fillet surface section 103.

Considering that the second planar surface section PS2 is located in a first plane PL1, the combination of the convex transition surface section CS2 and a region of the concave slot fillet surface section 103 adjoining the convex transition surface section CS2 forms a local recess UC (or undercut) in respect of the first plane PL1. In fact a transverse displacement of the surface is achieved by this configuration. With the term local recess it is not meant a cavity such that the surface will increase back again to the same level where it started. Only a drop of the surface is meant, similar to a profile that you would reach if the surface profile follows a mathematical function of arc cotangent, i.e. arccot(x).

Figure 7:
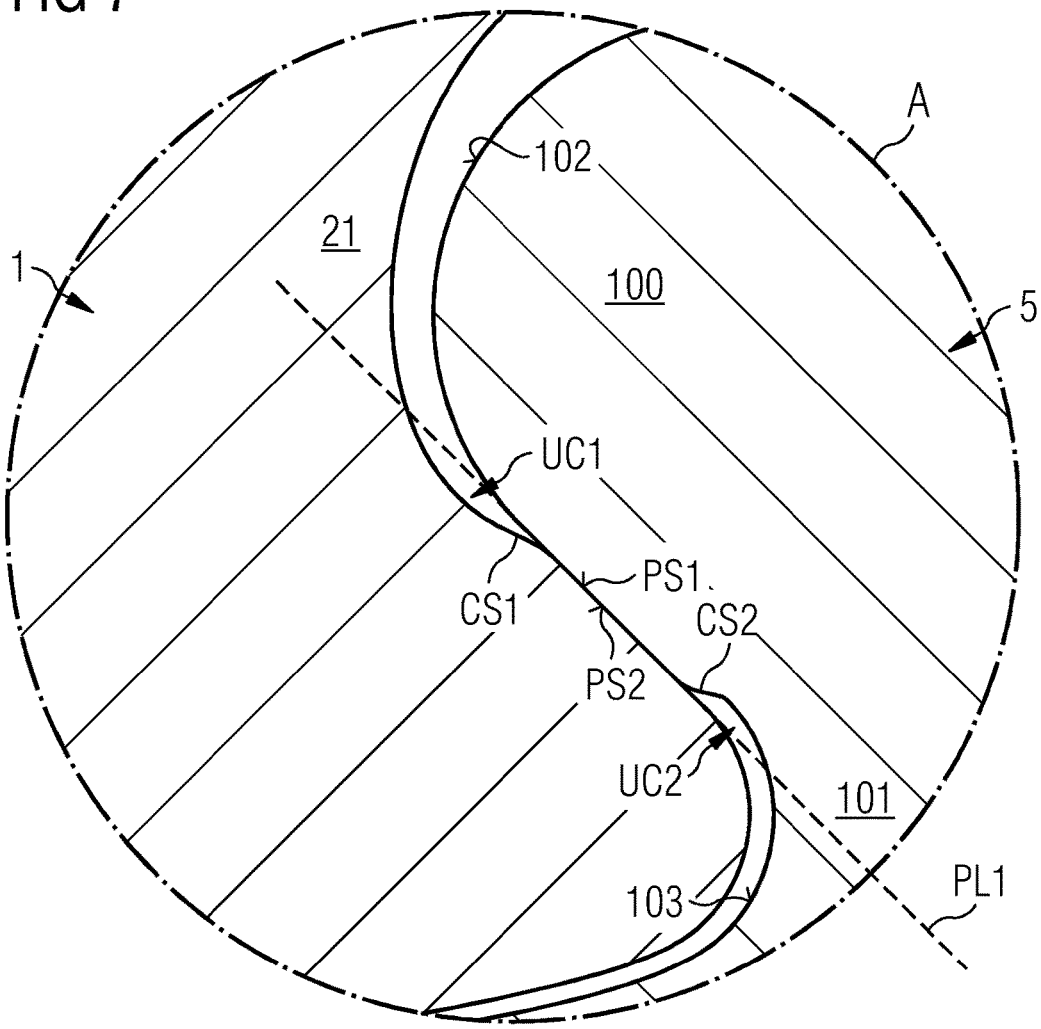
FIG. 7: shows an enlarged area of an alternative embodiment of a combination of an inventive blade and an inventive disc.

Referring to FIG. 7, a further embodiment is shown in which the surface of the blade root 1 and the surface of the disc slot 6 have each a local recess as explained before. The blade root 1 is configured as discussed in reference to FIGS. 4 and 5. The disc slot 6 is configured as discussed in reference to FIG. 6. The blade root now shows an undercut that is called first undercut UC 1 and the disc slot show an undercut that is called second undercut UC2.

As a preferred configuration, the first undercut UC1 will be at an opposite end of a contact area of the first planar surface section PS1 and the second planar surface section PS2 compared to the second undercut UC2. Thus the blade surface increases the distance to the first plane PL1 in which the first planar surface section PS1 and the second planar surface section PS2 are located due to the convex surface section CS1 of the blade, whereas the slot surface increases the distance to the first plane PL1 due to the convex transition surface section CS2 of the disc.

Figure 8:
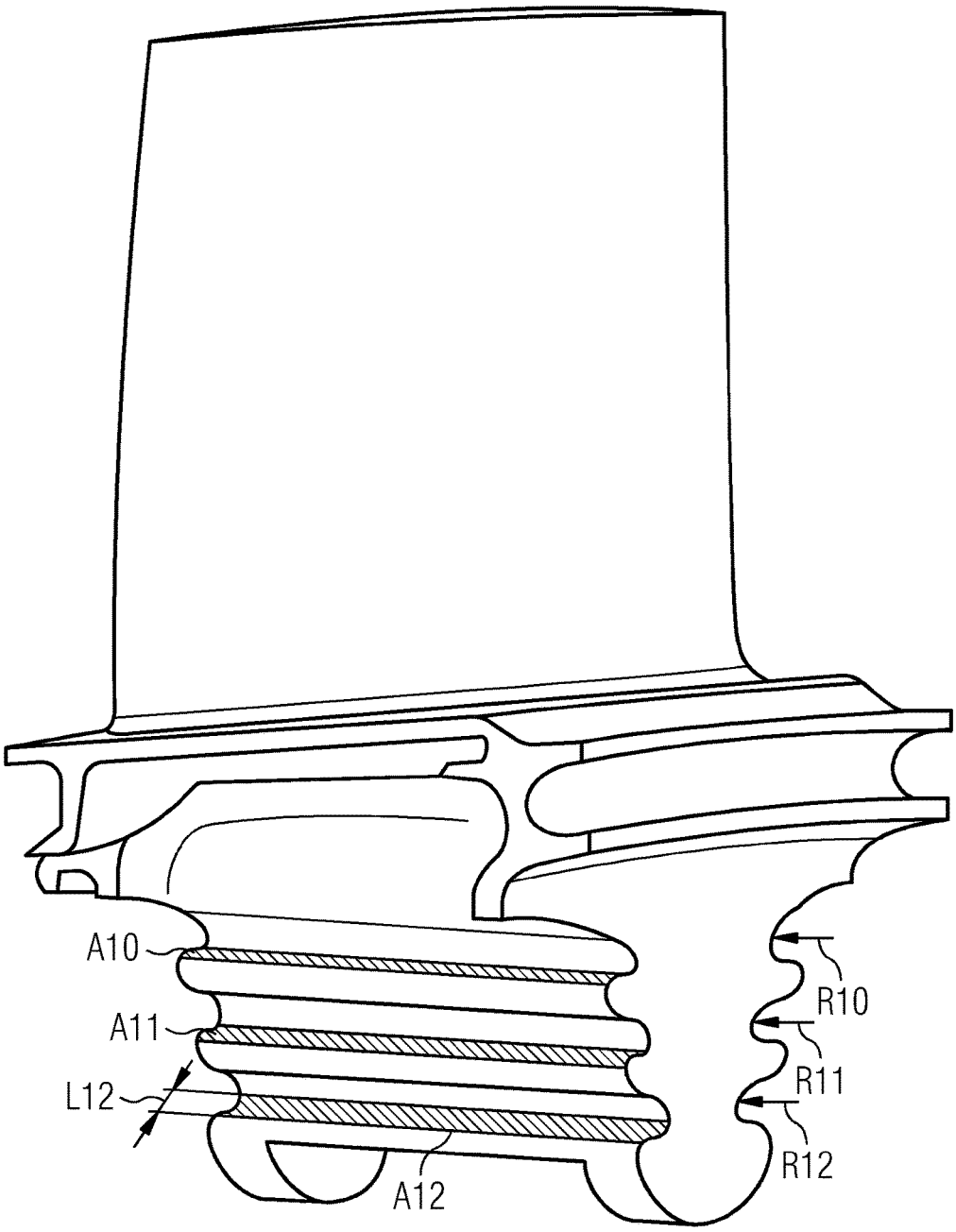
FIG. 8: illustrates an inventive blade in a perspective view.

Showing the embodiments of FIG. 4, 5, or 7 from a different angle, the first planar surface section PS1 and further planar surface sections of the further lobes of the blade root 1 also can be seen in FIG. 8 which shows an inventive turbine blade 2 in a perspective view. The first planar surface section PS1—defining a first planar expansion A10—for the most upward flanks 31, 31' is highlighted and represents the area of contact to the corresponding surface of the slot 6 of the disc 5, which is not shown in FIG. 8. The first planar surface section PS1 is a substantially flat and rectangular, as indicated by the first planar expansion A10.

Furthermore, a second planar expansion A11 of a medium lobe is shown, which is preferably greater than the first planar expansion A10. Particularly the second planar expansion A11 may be increased by 30% compared to the first planar expansion A10.

Finally a third planar expansion A12 of a lowest lobe is also given in FIG. 8, which is preferably greater than the first planar expansion A10 and may be equal to or greater than the second planar expansion A11. The expansion of the third planar expansion A12 is defined by a length L12 of the flank 33 and the axial length of the blade root 1.

The form of the surface between the lower lobes 13, 13' and the bottom 10 may be unmodified over the axial length. Alternatively, as shown in the figure, a middle section may have a recess, which may be used to form an inlet for cooling air which should guided into the interior of the blade.

In FIG. 8 also fillet radii are indicated as R10, R11, and R12. It may be considered a simplification that the fillets only follow one section of a circular cylinder or of an elliptic cylinder. The fillet may be composed of several sections which can be defined via a plurality of fillet radii, as it is shown in FIG. 3. Nevertheless it should be understood that all the lobes and fillets may have generally a similar or the same profile so that although only one lobe and one fillet is shown in FIG. 5-7, all or at least several of the other lobes and fillets can in fact be implemented similarly with the inventive undercuts UC1 and/or UC2.

Embodiments as introduced before may have a substantial benefit in regards of the lifetime of a blade. Stresses can be avoided that could result in cracks.

It has to be noted that that it may be advantageous if exactly three pairs of lobes and three pairs of fillets may be present on the blade root. Possibly other configurations may also be possible.

Furthermore it has to be noted that the shown embodiments should apply in non-operating situations as well as during operation.

The invention claimed is:

1. A blade root, comprising:

a plurality of opposite pairs of lobes, each of the pair of lobes being arranged substantially mirror-symmetrical and each lobe comprising a convex lobe surface section;

a plurality of opposite pairs of fillets, each of the pair of fillets being arranged substantially mirror-symmetrical and each fillet comprising a concave fillet surface section;

a plurality of flanks, wherein the lobes and the fillets are arranged in an alternating order and each of the flanks is arranged between one of the lobes and one of the fillets;

a bottom of the blade root;

wherein a first flank of the plurality of flanks faces away from the bottom of the blade root and has a first planar surface section, which transitions directly to a curved convex surface section, the first planar surface section being located in a first plane, wherein a convex lobe surface section of a lobe of the plurality of opposite pairs of lobes transitions directly to the first planar surface section, and wherein the concave fillet surface section is adjacent to the curved convex surface section, and wherein the curved convex surface section and a region of the concave fillet surface section adjoining the curved convex surface section form a local recess in respect of the first plane.

2. The blade root according to claim 1, wherein the local recess is formed such that the convex surface section increases an orthogonal distance to the first plane in direction from its first end at which the convex surface section merges into the first planar surface section to its second end at which the convex surface section merges into the concave fillet surface section.

3. The blade root according to claim 1, wherein the convex surface section merges into the first planar surface section with a smooth transition.

4. The blade root according to claim 1, wherein the convex surface section merges into the concave fillet surface section with a smooth transition.

5. The blade root according to claim 1, wherein each of the pair of lobes comprising most distal surface sections defining a widest distance between opposite surfaces of each of the pair of lobes, and wherein the widest distance between opposite surfaces of each of the pair of lobes is shortest for the pair of lobes closest to the bottom and increases for each pair of lobes with larger distance to the bottom.

6. The blade root according to claim 1, wherein each of the pair of fillets comprising minimum distant surface sections define a narrowest distance between opposite surfaces of each of the pair of fillets, and wherein the narrowest distance between opposite surfaces of each of the pair of fillets is shortest for the pair of fillets closest to the bottom and increases for each pair of fillets with larger distance to the bottom.

7. The blade root according to claim 1, wherein a first fillet radius of a first fillet of the plurality of fillets is arranged at a closest first position in regards to the bottom of the blade root, and wherein a second fillet radius of a second fillet of the plurality of fillets is arranged at a more distant second position in regards to the bottom of the blade root and compared to the first position the first fillet radius being substantially equal to the second fillet radius.

8. A blade root according to claim 1, wherein the plurality of opposite pairs of lobes and the plurality of opposite pairs of fillets form substantially two corrugated edgeless surfaces, the surfaces being symmetrical to a plane of symmetry and being continuously progressing away from the bottom free of overhangs and free of surfaces perpendicular to the plane of symmetry.

9. A blade root according to claim 1, wherein the first planar surface section being planar under zero loading and during operation.

10. A blade, comprising:

an aerofoil;

a platform from which the aerofoil extends upwardly; and a blade root configured according to claim 1, the blade root extending downwardly from the platform.

11. A rotor disc, comprising:

a plurality of disc slots, each of the plurality of disc slots, comprising:

a plurality of opposite pairs of slot lobes, each of the pair of slot lobes being arranged substantially mirror-symmetrical and each slot lobe comprising a convex slot lobe surface section;

a plurality of opposite pairs of slot fillets, each of the pair of slot fillet being arranged substantially mirror-symmetrical and each slot fillet comprising a concave slot fillet surface section;

a plurality of slot flanks, wherein the slot lobes and the slot fillets are arranged in an alternating order and each of the slot flanks is arranged between one of the slot lobes and one of the slot fillets; and a bottom of the disc slot, wherein a first slot flank of the plurality of slot flanks faces substantially towards the bottom of the disc slot and has a second planar surface section, which transitions directly to a curved convex transition surface section, the second planar surface section being located in a first plane, wherein the convex slot lobe surface section transitions directly to the second planar surface section, and wherein the concave slot fillet surface section is adjacent to the curved convex transition surface section, and wherein the curved convex transition surface section and a region of the concave slot fillet surface section adjoining the curved convex transition surface section form a local recess in respect of the first plane.

12. A turbomachine assembly, particularly for a turbine, comprising:

a rotor disc with a plurality of disc slots;

a plurality of blades as defined according to claim 10, each inserted into the plurality of disc slots;

wherein the disc slots and the blades are arranged such that during operation areas of contact between a surface of the disc slots and a surface of the blades are limited to the first planar surface section of the first flank and to further planar surface sections of further ones of the plurality of flanks of the blade root.

13. A turbomachine assembly, particularly for a turbine, comprising:

a rotor disc as defined according to claim 11;

a plurality of blades, each inserted into the plurality of disc slots;

wherein the disc slots and the blades are arranged such that during operation areas of contact between a surface of the disc slots and a surface of the blades are limited to the second planar surface section of the first slot flank and to further planar surface sections of further ones of the plurality of slot flanks of the disc slot.

* * * * *